US010793332B2

(12) United States Patent
Newman

(10) Patent No.: US 10,793,332 B2
(45) Date of Patent: Oct. 6, 2020

(54) SYSTEM AND METHOD FOR PALLETLESS SHIPMENT OF GAS CYLINDER ARRAYS

(71) Applicant: Shmuel Dovid Newman, Redondo Beach, CA (US)

(72) Inventor: Shmuel Dovid Newman, Redondo Beach, CA (US)

(73) Assignee: YSN Imports, Inc., Gardena, CA (US)

( * ) Notice: Subject to any disclaimer, the term of this patent is extended or adjusted under 35 U.S.C. 154(b) by 343 days.

(21) Appl. No.: 15/969,787

(22) Filed: May 3, 2018

(65) Prior Publication Data

US 2018/0319561 A1 Nov. 8, 2018

Related U.S. Application Data

(62) Division of application No. 14/869,351, filed on Sep. 29, 2015, now Pat. No. 9,975,678.

(Continued)

(51) Int. Cl.
*B65D 71/72* (2006.01)
*B65B 17/02* (2006.01)

(Continued)

(52) U.S. Cl.
CPC ..... *B65D 71/72* (2013.01); *B65B 17/02* (2013.01); *B65B 61/14* (2013.01); *B65D 71/0096* (2013.01); *B65D 71/04* (2013.01)

(58) Field of Classification Search
CPC ..... B65D 19/00; B65D 21/02; B65D 25/00; B65D 71/0096; B65D 71/02; B65D 71/04; B65D 71/70; B65D 71/72; B65D 77/00; B65D 85/62; B65B 13/00; B65B 13/02; B65B 17/02; B65B 27/04; B65B 35/50; B65B 61/14; F17C 2201/0104

(Continued)

(56) References Cited

U.S. PATENT DOCUMENTS 3,631,974 A * 1/1972 Schaefer ..... F17C 13/084 206/0.6
3,638,790 A * 2/1972 Schmid ..... B65D 71/0096 206/446

(Continued)

*Primary Examiner* — Hemant Desai
*Assistant Examiner* — Jacob A Smith
(74) *Attorney, Agent, or Firm* — Lance M. Pritikin

(57) ABSTRACT

A system and method are provided for palletless shipment of gas cylinder arrays. A three-dimensional array of gas cylinders is formed from a plurality of vertically-stacked two-dimensional subarrays. First elongated voids extend through the array in a width direction at a first handle elevation. Second elongated voids extend through the array in a depth direction at a second handle elevation. The first and second elongated voids are bilaterally bounded by handle portions of adjacent gas cylinders, and vertically bounded by upper and lower surfaces of surrounding cylinders. Pairs of tunnel elements are disposed within respective elongated voids and are each configured to releasably receive a corresponding forklift tong. Vertically-disposed pillars may be provided to increase the rigidity and load distribution of the system. Flaps may radiate from the pillars to minimize impact and abrasion between adjacent cylinders during shipment. Key system components may be inexpensively formed from recyclable, lightweight materials.

8 Claims, 8 Drawing Sheets

Related U.S. Application Data

(60) Provisional application No. 62/057,185, filed on Sep. 29, 2014.

(51) Int. Cl.
*B65B 61/14* (2006.01)
*B65D 71/00* (2006.01)
*B65D 71/04* (2006.01)

(58) Field of Classification Search
USPC ..... 206/216, 319, 386, 446, 499, 509, 511, 206/598, 600, 814; 53/48.1, 176, 398, 53/399, 443, 447, 449; 108/57.13
See application file for complete search history.

(56) References Cited

U.S. PATENT DOCUMENTS 3,640,048 A * 2/1972 Zelnick ..... B65B 9/026 53/442
4,865,202 A * 9/1989 Day ..... B65D 19/0018 206/597
5,144,897 A * 9/1992 Avery ..... B65D 71/0096 108/55.3
5,174,448 A * 12/1992 Flaig ..... B65D 19/20 206/386
5,330,050 A * 7/1994 Stansbury, Jr. ..... B65D 71/70 206/386
5,507,237 A * 4/1996 Barrow ..... B65D 19/08 108/53.1
5,551,563 A * 9/1996 Allen ..... B65D 71/0096 206/394
5,709,252 A * 1/1998 Princiotta ..... B60P 3/055 108/55.3
6,026,958 A * 2/2000 Kelly ..... B65D 1/243 206/3
6,145,682 A * 11/2000 Speck ..... B65D 88/123 206/600
6,209,839 B1 * 4/2001 O'Malley ..... B65D 19/44 248/346.02
6,230,892 B1 * 5/2001 Przytulla ..... B65D 1/12 206/509
6,315,122 B1 * 11/2001 McCord ..... B65D 19/38 206/408
6,332,535 B1 * 12/2001 Usui ..... B65D 19/0069 108/51.3
6,386,384 B1 * 5/2002 Chohfi ..... F17C 13/06 206/0.6
7,017,741 B1 * 3/2006 Williamson ..... F17C 13/084 206/386
7,137,517 B2 * 11/2006 Lowry ..... B65D 5/5033 211/188
7,644,560 B2 * 1/2010 Bowden ..... B65B 11/025 206/213.1
7,900,775 B2 * 3/2011 Hojholt ..... B65D 71/0088 206/597
8,250,835 B2 * 8/2012 Kenneally ..... B65D 19/38 150/154
8,333,275 B2 * 12/2012 McFarlane ..... B65D 21/0234 206/144
2004/0188308 A1 * 9/2004 Mulligan ..... F17C 13/084 206/509
2004/0251154 A1 * 12/2004 Kulbeth ..... B65D 19/18 206/386
2005/0204707 A1 * 9/2005 Duke ..... B65D 71/0088 53/445
2007/0074978 A1 * 4/2007 Koike ..... B65D 1/0096 206/216
2007/0251857 A1 * 11/2007 Watanabe ..... B65D 19/02 206/600
2009/0255893 A1 * 10/2009 Zummo ..... B65D 21/0204 215/10
2011/0017686 A1 * 1/2011 Burra ..... B65D 71/70 211/71.01
2013/0206043 A1 * 8/2013 Baltz ..... B65D 19/0004 108/57.13
2013/0327669 A1 * 12/2013 Sueoka ..... B65D 57/00 206/453
2014/0028037 A1 * 1/2014 Ness ..... B65D 90/006 294/68.1
2014/0109523 A1 * 4/2014 Nelson ..... B65B 11/006 53/461
2014/0367297 A1 * 12/2014 Kelly ..... B65D 71/0096 206/509

* cited by examiner

SYSTEM AND METHOD FOR PALLETLESS SHIPMENT OF GAS CYLINDER ARRAYS

RELATED APPLICATIONS

This application is a divisional of U.S. patent application Ser. No. 14/869,351 filed Sep. 29, 2015, now U.S. Pat. No. 9,975,678, which claims the benefit of U.S. Provisional Application No. 62/057,185 filed Sep. 29, 2014. All of the above-identified applications are hereby incorporated by reference in their entireties as though fully and completely set forth herein.

TECHNICAL FIELD

The present invention relates generally to the field of product packaging and shipment. More particularly, the invention involves systems and methods for packaging an array of gas cylinders for space-efficient and secure storage and shipment.

BACKGROUND

Conventional systems and methods for packaging and shipping a three-dimensional array of gas cylinders, such as propane tanks, generally require a pallet to be placed under the array to facilitate lifting by a forklift. Such pallets add height to the overall shipment package, thereby restricting the number of gas cylinders which can fit vertically within a typical shipping truck or shipment container. By way of example, a typical conventional propane tank shipment configuration contains 60 propane tanks in an array of four wide, three deep and five high. Only one such configuration can fit vertically in a typical shipping truck. Moreover, once the outer securement means is removed during unpackaging, an array having five propane tanks high typically requires a worker to use a ladder to access and remove the upper level of tanks from the array. This presents an undesirable safety risk during unpackaging and shelving operations. Further, conventional propane tank shipment systems and methods frequently rely on expansive amounts plastic wrapping to secure the array of propane tanks together during shipment.

What is needed is a system and method which allows a three-dimensional array of gas cylinders to be moved by forklift and shipped in a manner which simultaneously optimizes space efficiency, protects the product from damage, improves safety, reduces packaging costs and waste materials, and uses recyclable components.

SUMMARY

In an example embodiment of a system for palletless shipment of gas cylinder arrays, a three-dimensional array of gas cylinders may be formed from a plurality of vertically-stacked two-dimensional subarrays. Each subarray is defined by a subset of gas cylinders which are laterally tightly disposed with respect to one another. Each gas cylinder typically includes an upper surface, a lower surface and a handle portion extending from its upper surface. Each subarray has at least two columns extending in a depth direction and at least three rows extending in a width direction. As a byproduct of the compact arrangement of gas cylinders in the array, a pair of first elongated voids extend through the array in the width direction at a first handle elevation. Each first elongated void is bilaterally bounded by respective handle portions of the subarray below. It is also vertically bounded by the upper surface of the gas cylinders immediately below the void and the lower surfaces of the gas cylinders immediately above the void. Each of a pair of first tunnel elements is disposed within a respective one of the first elongated voids and is configured to releasably receive a corresponding forklift tong.

Where each gas cylinder includes a foot portion extending from its lower surface, and, the vertical stacking preferably involves at least partial nested engagement of the handle portions of each lower subarray with the foot portions of the respective subarray immediately thereabove.

Additional tunnel elements may be provided to allow a forklift to engage the system at various elevations in the array, and at various lateral angles with respect to the array. Moreover, the key components of the system may be inexpensively formed from cardboard or similar recyclable, lightweight materials. Improved rigidity and weight distribution may be imparted to the system by way of vertically-oriented pillar elements configured to engage the tunnel elements. The pillar elements may also provide additional protection to the gas cylinders during shipment, by including flaps capable of shielding closely adjacent gas cylinders from rubbing against one another.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
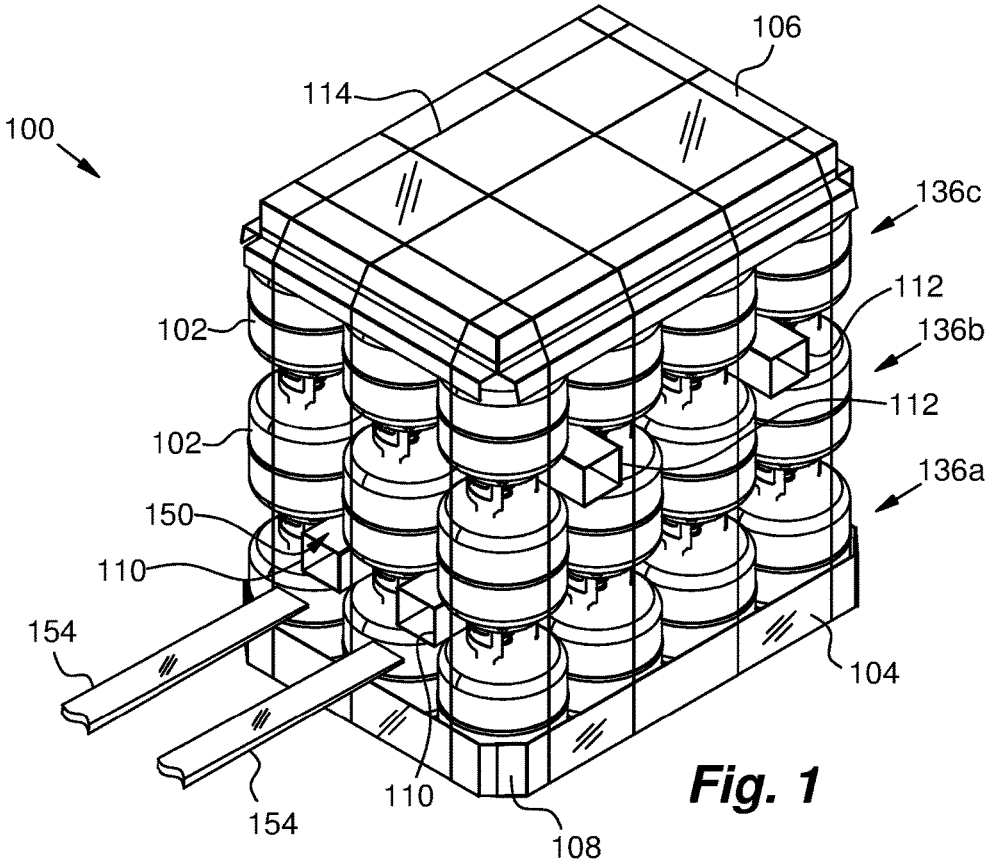
FIG. 1 is a diagrammatic perspective view of a package system in accordance with one non-limiting embodiment of the present invention.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE PREFERRED EMBODIMENTS

The following description of preferred embodiments generally relates to systems and methods for pattetlessly shipping arrays of gas cylinders, such as propane tanks and the like.

Figure 8:
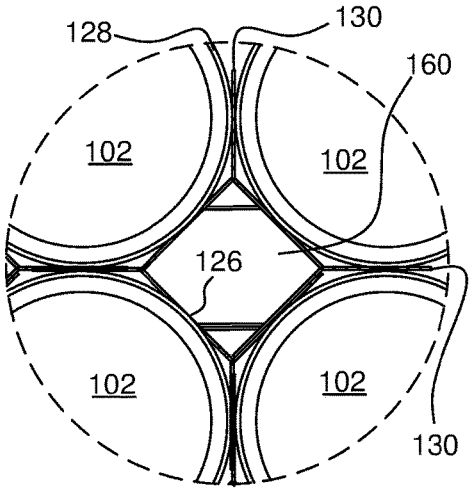
FIG. 8 is a diagrammatic is a magnified view of detail 8 in FIG. 5, illustrating multiple flap members of a pillar element protectively disposed between weld lines of adjacent gas cylinders.
Figure 9:
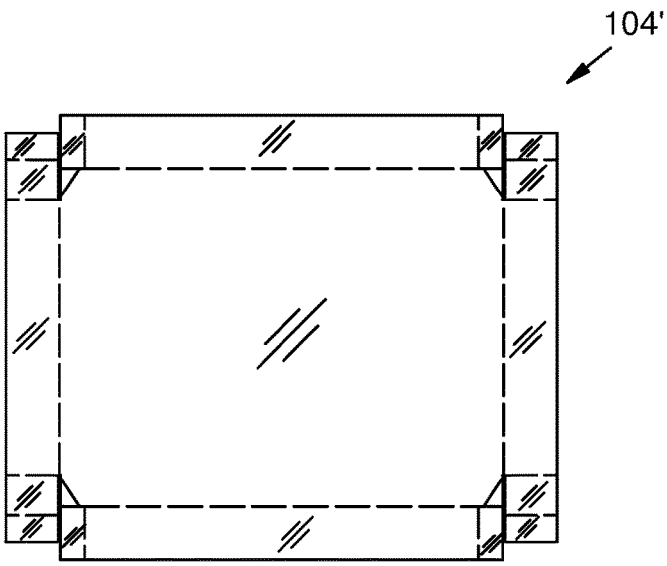
FIG. 9 is a diagrammatic plan view of a bottom tray element box blank in accordance with the system embodiment shown throughout the several FIGS.
Figure 11:
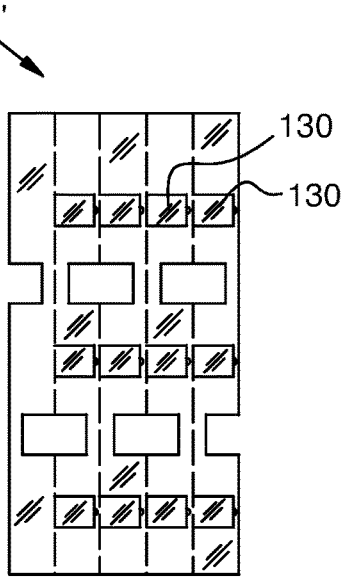
FIG. 11 is a diagrammatic plan view of a pillar element box blank in accordance with the system embodiment shown throughout the several FIGS.
Figure 10:
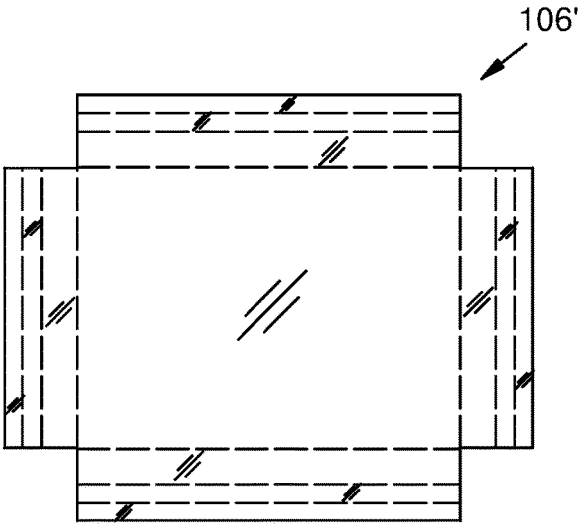
FIG. 10 is a diagrammatic plan view of a cap element box blank in accordance with the system embodiment shown throughout the several FIGS.
Figure 12:
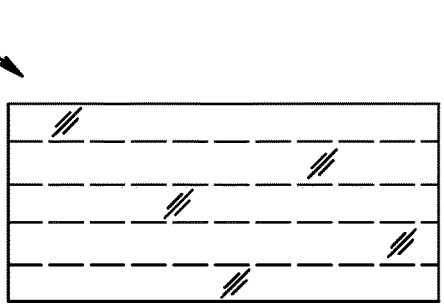
FIG. 12 is a diagrammatic plan view of a first tunnel element box blank in accordance with the system embodiment shown throughout the several FIGS.
Figure 13:
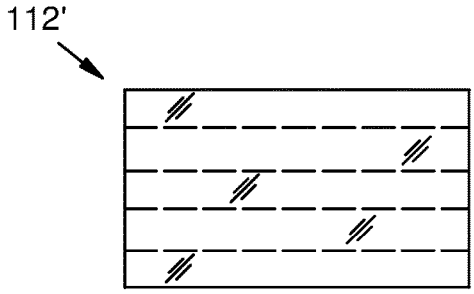
FIG. 13 is a diagrammatic plan view of a second tunnel element box blank in accordance with the system embodiment shown throughout the several FIGS.

With particular reference to the figures, one or more non-limiting embodiments of a system are illustrated generally at 100. Embodiments of a system 100 may comprise an array of gas cylinders 102, a base tray element 104, a cap element 106, and at least a pair of first tunnel elements 110. The base tray element 104 may have corner portions 108 which are chamfered (as shown in FIGS. 1 and 8 for example), filleted or the like. Certain embodiments, such as the one illustrated for example in FIG. 1, may comprise a pair of second tunnel elements 112 in place of or in addition to the pair of first tunnel elements 110. In such embodiments, the first tunnel elements 110 and second tunnel elements 112 may preferably be disposed orthogonally to one another, and may reside at different heights in the system 100. The first and second tunnel elements are each adapted to receive a respective tong of a forklift.

With reference to FIGS. 14-17, embodiments of a system 100 may preferably comprise pillar elements 126. Referring to FIG. 8 for illustration, such pillar elements 126 may preferably be configured for lateral disposition between four respective gas cylinders 102. Moreover, the pillar elements 126 may include a plurality of flap members 130, each being positionable between respective laterally-adjacent gas cylinders 102 to shield those cylinders (e.g., their weld lines 128) from destructively contacting one another during, for example, movement or transportation of the system 100. In preferred embodiments, the pillar elements 126 may also include a first tunnel receiving aperture 132 and a second tunnel-receiving aperture 134. The first tunnel receiving aperture 132 may be configured to receive a first tunnel element 110 therethough, and the second tunnel aperture 134 may be configured to receive a second tunnel element 112 therethrough.

Figure 2:
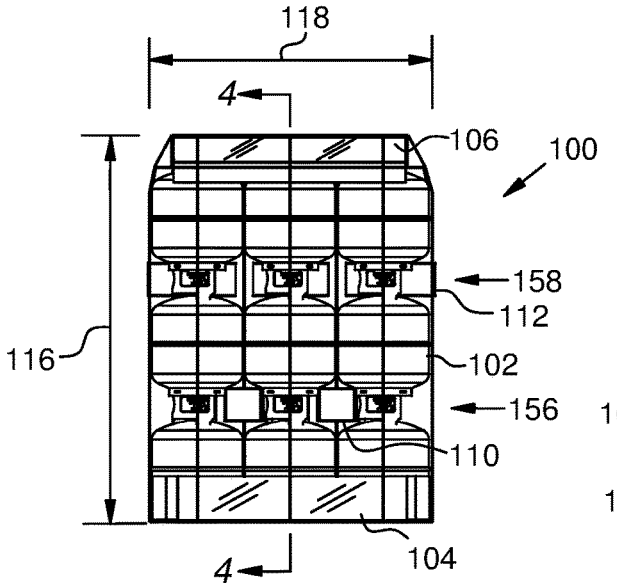
FIG. 2 is a diagrammatic side view of the embodiment depicted in FIG. 1.
Figure 3:
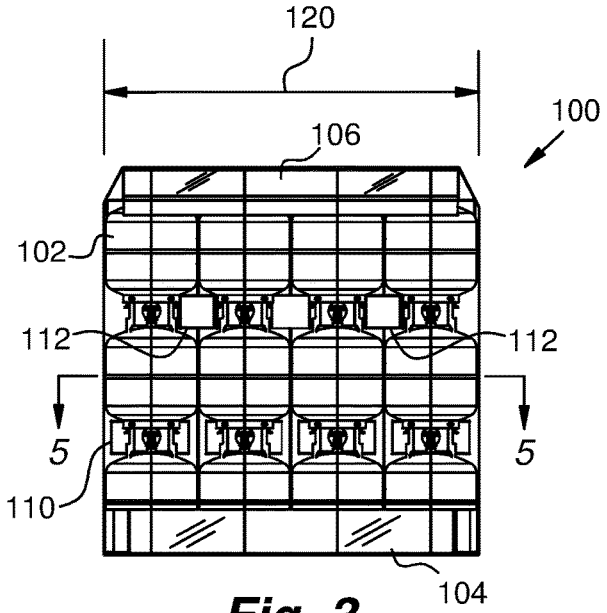
FIG. 3 is a diagrammatic side view of the embodiment depicted in FIG. 1.
Figure 4:
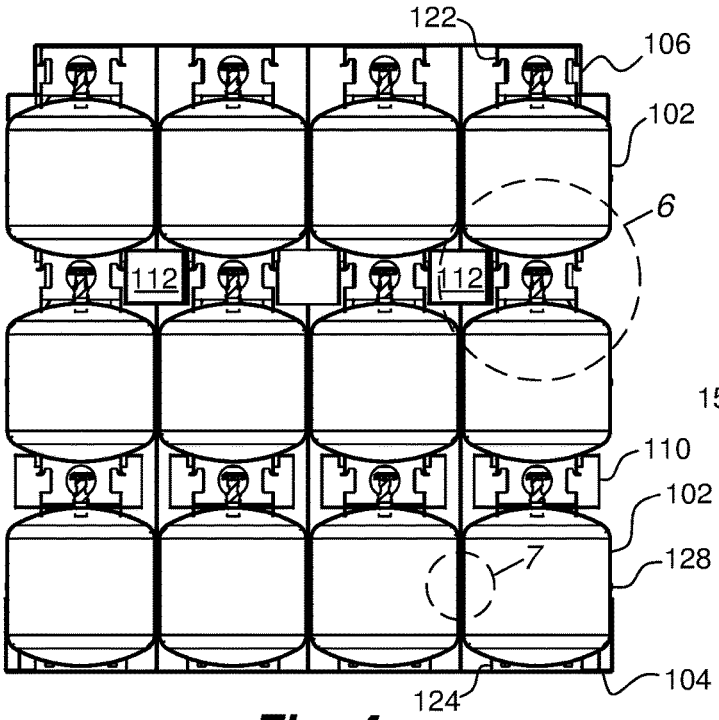
FIG. 4 is a diagrammatic cross-sectional view take along lines 4-4 in FIG. 2.
Figure 6:
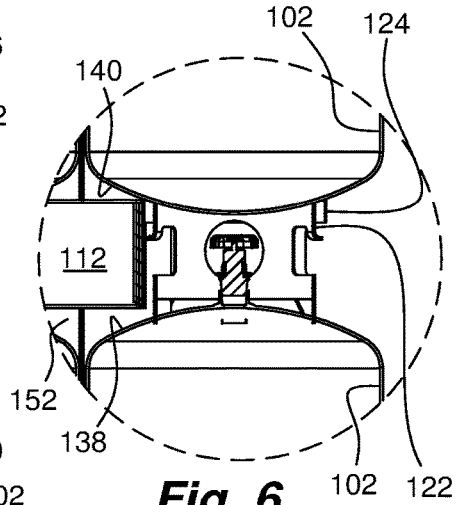
FIG. 6 is a diagrammatic magnified view of detail 6 in FIG. 4, illustrating the partial receipt of the handle ring of a lower gas cylinder within the foot ring of the gas cylinder of the respective upper gas cylinder, as well as a second tunnel element disposed in the space lateral of the handle ring.

Referring to FIG. 1, when the system 100 is in its assembled form, it may be secured by way of packing straps 114 or the like. Referring to FIGS. 2 and 3, the assembled system typically has height 116, depth 118 and width 120. Referring to FIG. 6 for illustration, the handle portion (or "handle ring") 122 of each lower gas cylinders 102 may be preferably partially received by or "nested within" the foot ring 124 of the gas cylinder 102 directly thereabove. This results in vertical space savings in the system 100. Referring to FIGS. 1-3, tunnel elements 110 and 112 may extend throughout the assembly 100. Further, as illustrated in FIGS. 4 and 6 for example, the tunnel elements 110 and 112 may preferably non-obtrusively reside within the gaps defined between the handle rings 122 of laterally-adjacent gas cylinders 102 and between the vessel walls of vertically adjacent gas cylinders 102.

Particular embodiments of a system 100 may be configured with only two levels of gas cylinders. In such embodiments, either the first tunnel elements 110 or the second tunnel elements 112 may not be included, and the shortened pillar elements 126 may correspondingly lack either the first tunnel apertures 132 or second tunnel apertures 134.

Referring to FIGS. 9-13, what are illustrated are example box blanks which correspond to respective embodiments of a bottom tray element 104, cap element 106, pillar element 126, first tunnel element 110 and second tunnel element 112. Some or all of these components may be formed of corrugated cardboard, such as double-walled, B-flute 275# bursting test with a Kraft finish, or an alternative material with similar performance characteristics. Such blanks can be folded about their fold lines or creases (shown in dashed lines in FIGS. 9-13), and the formed component may be secured in its operative configuration using tape, adhesive or the like.

Figure 5:
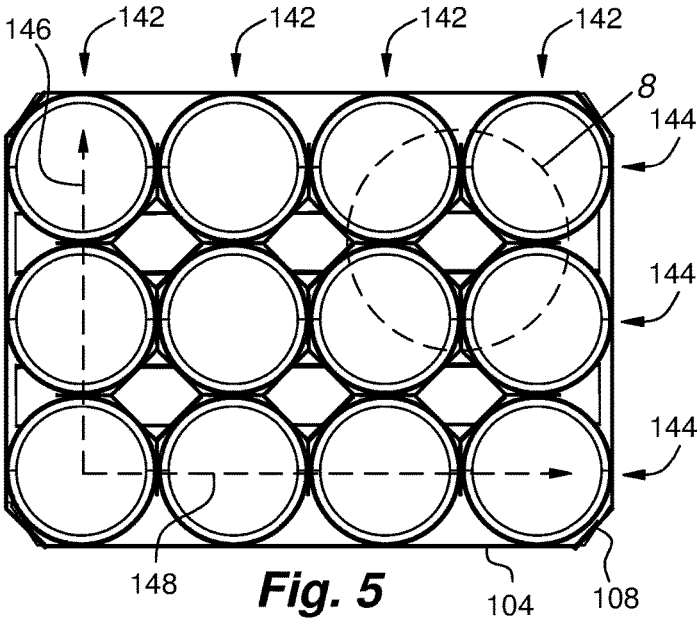
FIG. 5 is a diagrammatic cross-sectional view take along lines 5-5 in FIG. 3.

A system for palletless shipment of gas cylinder arrays preferably comprises a three-dimensional array of gas cylinders 102 and a pair of first tunnel elements 110. Referring to FIG. 1, the array is formed from a plurality of vertically-stacked two-dimensional subarrays (see, for example, subarrays 136*a*, 136*b* and 136*c*. Each such subarray is defined by a subset of gas cylinders 102 laterally disposed with respect to one another. Each gas cylinder 102 may include an upper surface 138, a lower surface 140 and a handle portion 122 extending from the upper surface 138. With reference to FIG. 5 for illustration, each subarray may have at least two columns 142 extending in a depth direction 146 and at least three rows 144 extending in a width direction 148. Referring to FIGS. 1 and 2, a pair of first elongated voids 150 typically extend through the array, for example in the width direction 148, at a first handle elevation 156.

Each of the first tunnel elements 110 may be disposed within a respective one of the first elongated voids and configured to releasably receive a corresponding forklift tong 154. With reference to FIGS. 4 and 6 for illustration, each elongated void discussed herein may preferably be bilaterally bounded by at least respective handle portions 122, and vertically bounded by at least respective upper surfaces 138 and lower surfaces 140 of immediately surrounding gas cylinders 102.

Referring again to FIGS. 4 and 6 for illustration, in preferred embodiments, each gas cylinder 102 may include a foot portion 124 extending, for example, from its lower surface 140. In such embodiments, the vertical stacking previously discussed may preferably involve at least partial nested engagement of the handle portions 122 of a lower subarray (e.g., 136*a*) with the foot portions 124 of the respective subarray immediately thereabove (e.g., 136*b*).

As illustrated for example in FIGS. 1-4, in certain preferred embodiments of a system, the array may comprise at least three subarrays. Similarly, each subarray may have at least three columns extending in the depth direction. In such embodiments, a pair of second elongated voids 152 (see, for example, FIGS. 4 and 6) may extend through the array in the depth direction 146 at a second handle elevation 158 (see FIG. 2). In particular preferred embodiments, the first and second handle elevations (e.g., 156 and 158) are distinct from one another. Thus, the system 100 may further comprise a pair of second tunnel elements 112, each of which may be disposed within a respective one of the second elongated voids and configured to releasably receive a corresponding forklift tong 154.

Figure 7:
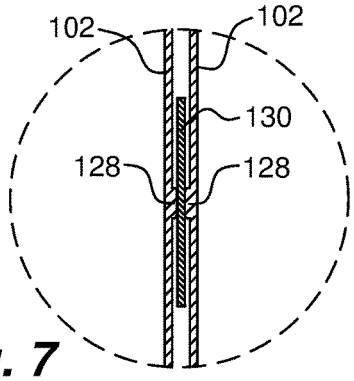
FIG. 7 is a diagrammatic is a magnified view of detail 7 in FIG. 4, illustrating a flap member protectively disposed between weld lines of adjacent gas cylinders.
Figure 14:
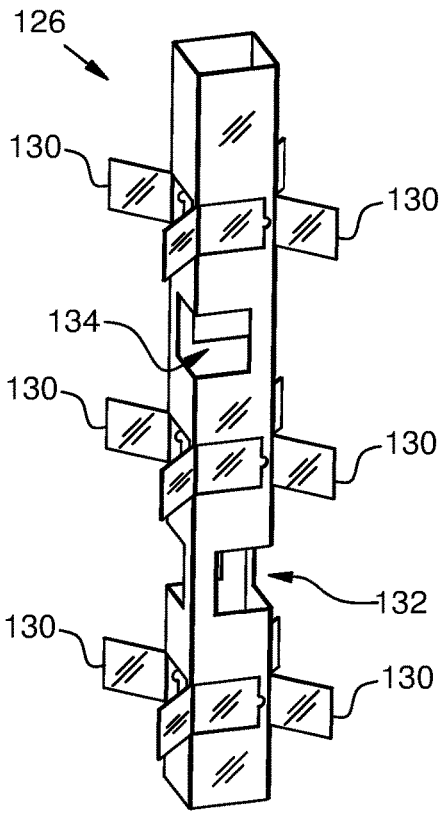
FIG. 14 is a diagrammatic perspective view of one embodiment of a pillar element.
Figure 15:
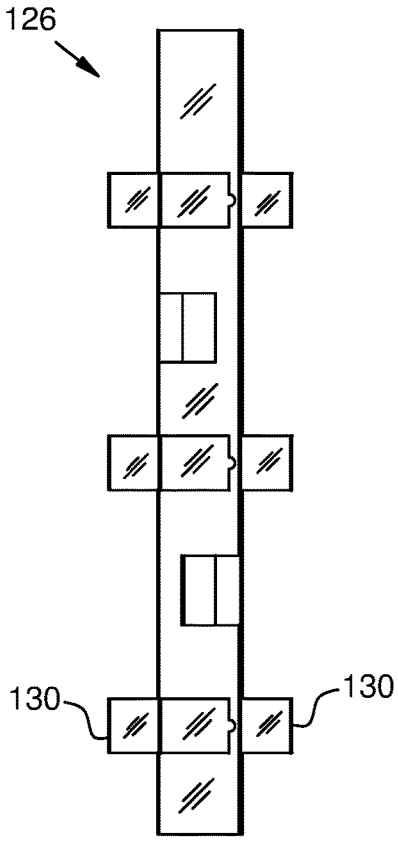
FIG. 15 is a diagrammatic side view of the pillar element of FIG. 14.
Figure 16:
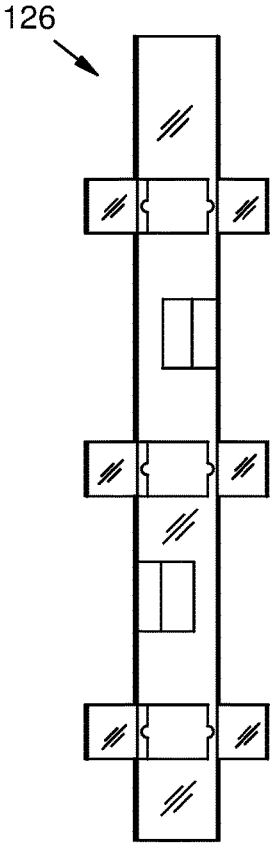
FIG. 16 is a further diagrammatic side view of the pillar element of FIG. 14, but orthogonal to the side view of FIG. 15.
Figure 17:
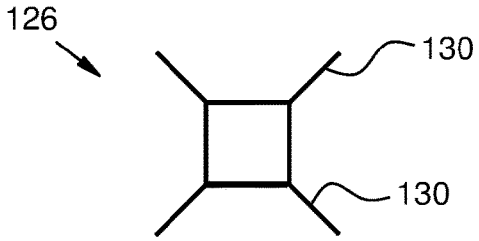
FIG. 17 is a diagrammatic end view of the pillar element of FIG. 14.
Figure 18:
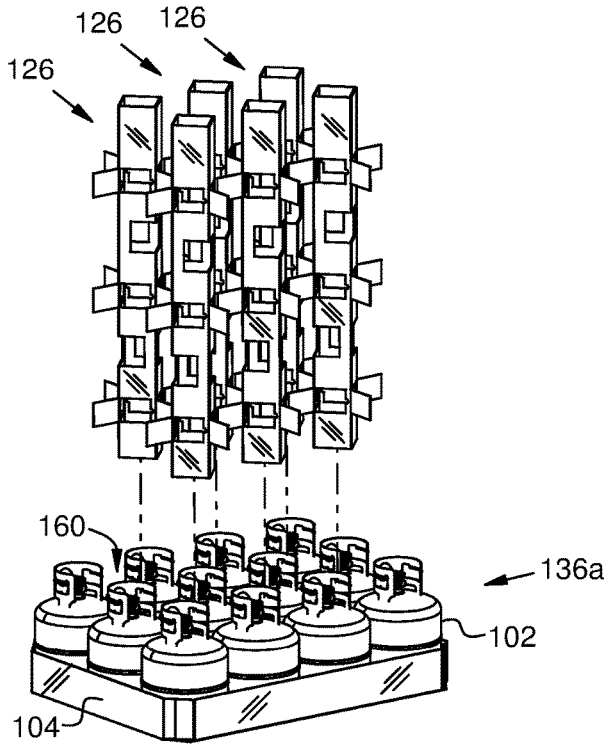
FIG. 18 is a diagrammatic perspective partially exploded view illustrating a multiplicity of pillar elements being inserted between a first subarray of gas cylinders placed in a bottom tray element.
Figure 19:
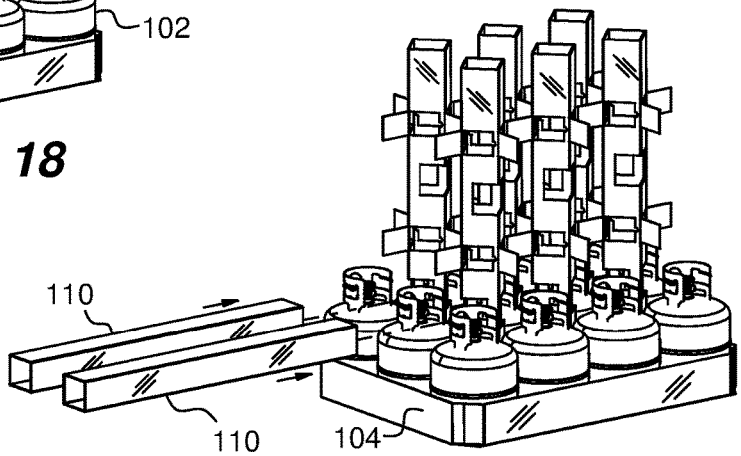
FIG. 19 is a diagrammatic perspective partially exploded view illustrating a pair of first tunnel elements being inserted into first tunnel receiving apertures of respective pillar elements.
Figure 20:
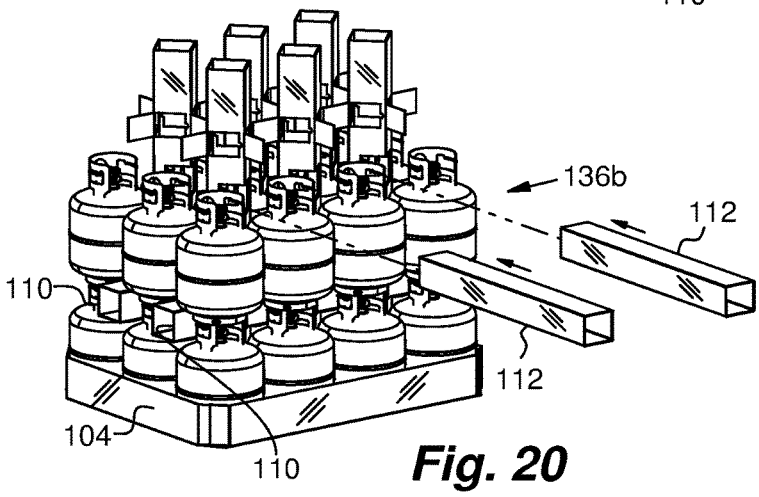
FIG. 20 is a diagrammatic perspective partially exploded view illustrating a pair of second tunnel elements being inserted into second tunnel receiving apertures of respective pillar elements, with a second subarray of gas cylinders having been placed on the first subarray.
Figure 21:
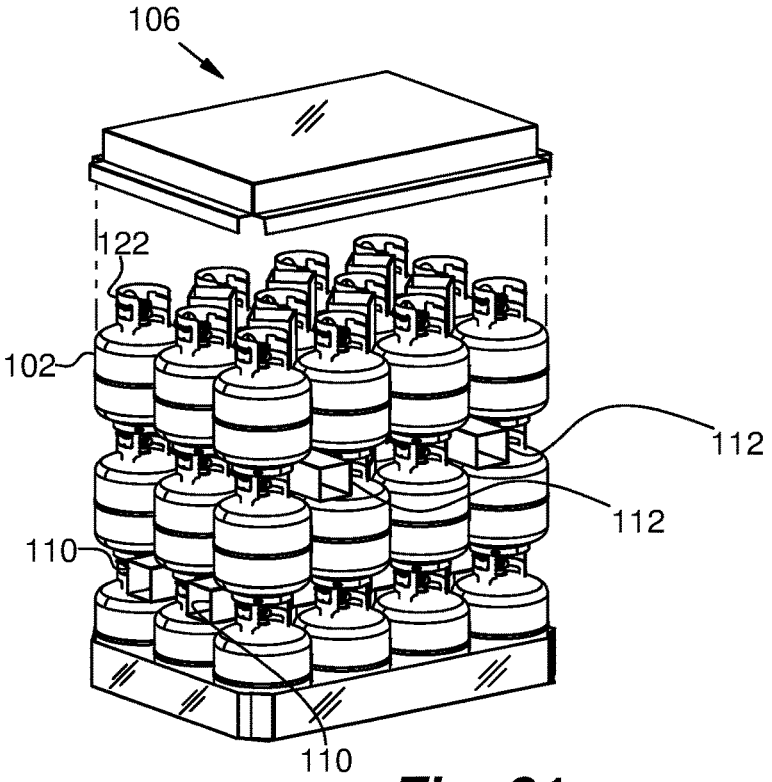
FIG. 21 is a diagrammatic perspective partially exploded view illustrating a cap element being placed atop the upper ends of the pillar elements and the third subarray of gas cylinders, such that the handle rings of the top cylinders about the lateral perimeter of the assembly are snuggly received by the upper portion of the cap element.
Figure 22:
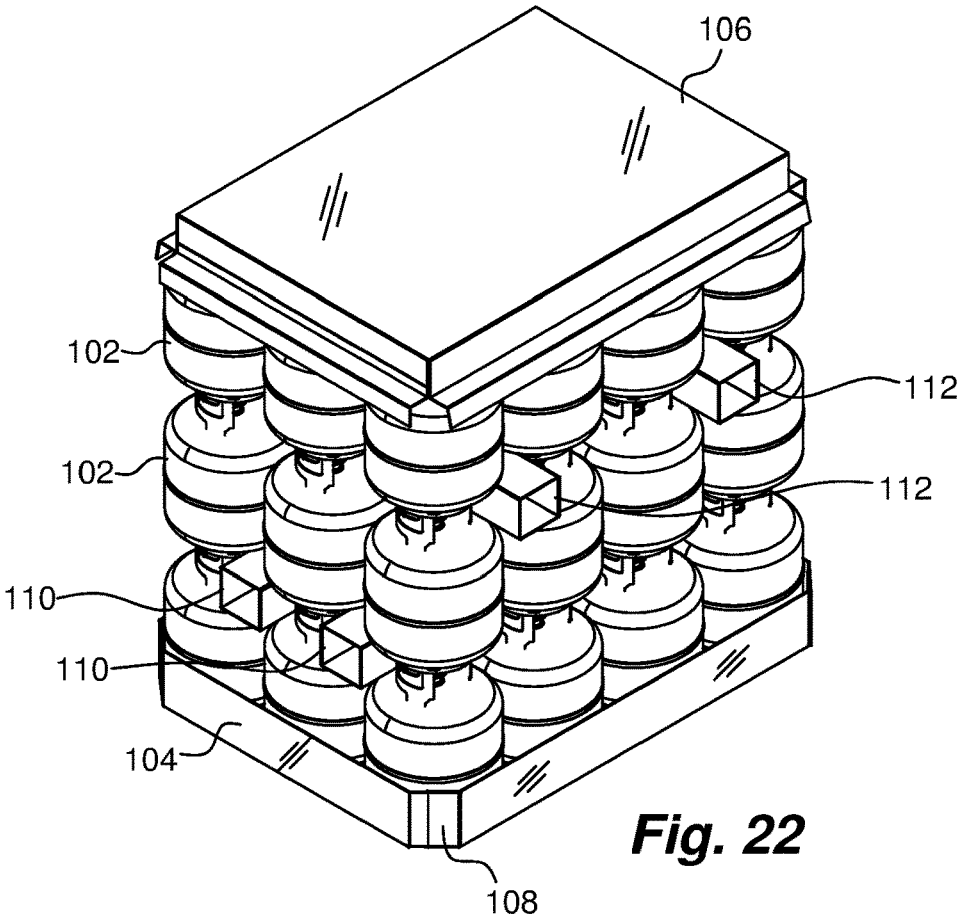
FIG. 22 is a diagrammatic perspective view of the fully-assembled system of FIG. 1, but shown without the securement straps.

Certain preferred embodiments of a system 100 may further comprise a multiplicity of third elongated voids 160 extending vertically through the array. Therefore, a plurality of pillar elements 126 may each be disposed within a respective third elongated void 160. With reference to FIG. 14, each pillar element 126 may preferably include a pair of tunnel receiving apertures (for example, 132 and 134) extending orthogonally to one another. As illustrated in FIGS. 19 and 20, each tunnel receiving aperture is preferably configured to receive a respective first tunnel element 110 or second tunnel element 112 therethrough. With reference to FIG. 8, each third elongated void is typically substantially defined by four respective adjacent gas cylinders 102 in each subarray. Moreover, with reference to FIGS. 14-17, each pillar element 126 may include flap members 130 extendable radially thereof. With reference to FIGS. 5, 7, 8, each such flap member 130 may be protectively disposed between weld lines 128 of a respective pair of adjacent gas cylinders 102.

Preferred embodiments of a system 100 may further comprise one or more of a base tray element 104, a cap element 106 and an array securement means. As illustrated, for example, in FIGS. 1 and 4, the base tray element 104 may be in at least partial receipt of a bottommost subarray (for example, 136*a*). Similarly, a cap element 106 may be in a least partial receipt of a topmost subarray (for example, 136*c*). An array securement means (for example, packing straps 114 or the like) may be provided for substantially rigidly securing the array between the base tray element and cap element.

In particular preferred embodiments a system 100, one or more of the first tunnel elements, second tunnel elements, pillar elements, base tray element and cap element are comprised substantially of corrugated cardboard. In such embodiments, the first tunnel elements, second tunnel elements, pillar elements, base tray element and cap element are preferably each formed from respective corrugated cardboard blanks.

FIGS. 18-22 sequentially illustrate certain key steps of one or more embodiments of a method for assembling a system 100 (packaging an array of gas cylinders) in accordance with the present invention.

Figure 24:
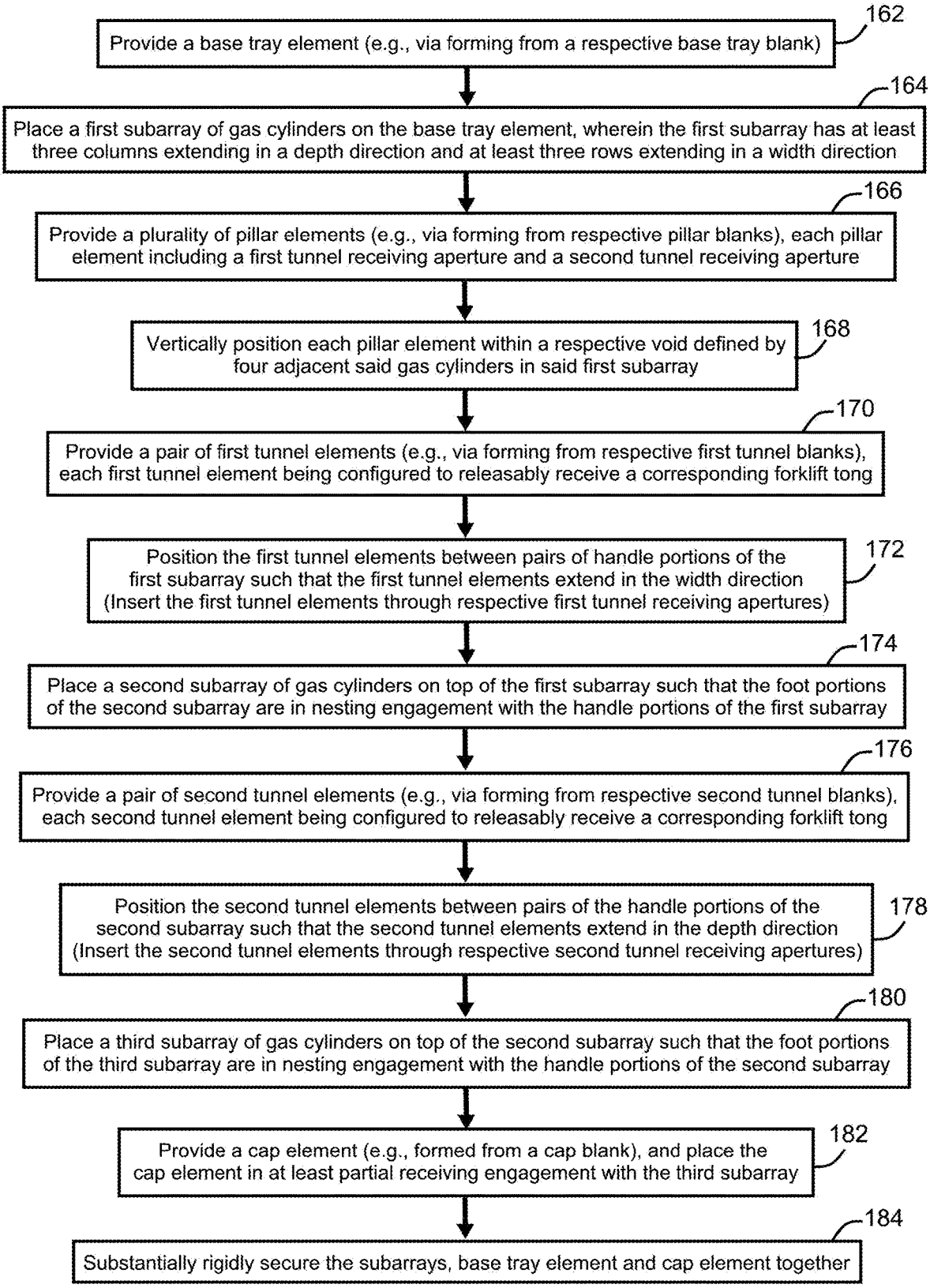
FIG. 24 is a diagrammatic flow chart representing steps comprised in one or more non-limiting examples of a method of packaging an array of gas cylinders for shipment.

A method of packaging an array of gas cylinders for palletless shipment may be comprised of, for example, one or more of the steps illustrated in FIG. 24. The method is not necessarily restricted to the particular order or steps shown in FIG. 24. At block 162, a base tray element 104 may be provided. The base tray element may be formed from a respective base tray blank 104'. At block 164, a first subarray 136*a* of gas cylinders 102 may be placed on the base tray element 104. With reference to FIG. 5, the first subarray 136*a* may have at least three columns 142 extending in a depth direction 146 and at least three rows 144 extending in a width direction 148. Each gas cylinder 102 may include a handle portion 122 and an opposing foot portion 124.

At block 170 of FIG. 24, a pair of first tunnel elements 110 may be provided. The first tunnel elements 110 may be formed, for example, from respective first tunnel blanks 110'. Each first tunnel element 110 is configured to releasably receive a corresponding forklift tong 154. At block 172, the first tunnel elements 110 may be positioned between pairs of handle portions 122 of the first subarray 136*a* such that the first tunnel elements 110 extend in the width direction 148. At block 174, a second subarray 136*b* of gas cylinders 102 may be placed on top of the first subarray 136*a* such that the foot portions 124 of the second subarray 136*b* are in nesting engagement with the handle portions 122 of the first subarray 136*a*. Such a relationship is illustrated, for example, in FIGS. 4 and 6.

At block 176, a pair of second tunnel elements 112 may be provided. The second tunnel elements 112 may be formed, for example, from respective second tunnel blanks 112'. Each second tunnel element 112 may be configured to releasably receive a corresponding forklift tong 154. At block 178, the second tunnel elements 112 may be positioned between pairs of handle portions 122 of the second subarray 136*b* such that the second tunnel elements 112 extend in, for example, the depth direction 146. At block 180, a third subarray 136*c* of gas cylinders 102 may be placed on top of the second subarray 136*b* such that the foot portions 124 of the third subarray are in nesting engagement with the handle portions 122 of the second subarray 136*b*. Such a relationship is illustrated, for example, in FIGS. 4 and 6.

At block 166, a plurality of pillar elements 126 may be provided. The pillar elements 126 may be formed, for example, from respective pillar blanks 126'. Referring to FIG. 14, each pillar element 126 may include a first tunnel receiving aperture 132 and a second tunnel receiving aperture 134. At block 168, each pillar element 126 may be vertically positioned within a respective void defined by four adjacent gas cylinders 102 in the first subarray 136*a*. Such construction is illustrated, for example, in FIGS. 8 and 18. Returning to block 172 of FIG. 24, during the positioning of the first tunnel elements 110, the first tunnel elements 110 may be inserted through at least one respective first tunnel receiving aperture 132. Such a process is illustrated, for example, in FIG. 19. Similarly, returning to block 178, during the positioning of the second tunnel elements 112, each second tunnel element 112 may be inserted through at least one respective second tunnel receiving aperture 134. Such a process is illustrated, for example, in FIG. 20. In certain preferred embodiments of the method, in each pillar element 126, the first tunnel receiving aperture 132 is orthogonal to the second tunnel receiving aperture 134.

Referring to FIGS. 14-17, in particular embodiments of a method, each pillar element 126 may include flap members 130 extendable radially thereof. In such embodiments, each flap member 130 may be placed in protective disposition between weld lines 128 of a respective pair of adjacent gas cylinders 102. See, for example, FIGS. 5 and 8.

At block 182 of FIG. 24, a cap element 106 may be provided. The cap element 106 may, for example, be formed from a respective cap blank 106'. The cap element 106 may be placed in at least partial receiving engagement with the uppermost subarray (e.g., third subarray 136*a*). At block 184, the subarrays, base tray element and cap element may be substantially rigidly secured together. Such securement may be provided by way of packing straps 114 or the like. The aforementioned blanks may be comprised of corrugated cardboard, such as double-walled, B-flute 275# bursting test with a Kraft finish, or an alternative material with similar performance characteristics.

Figure 23:
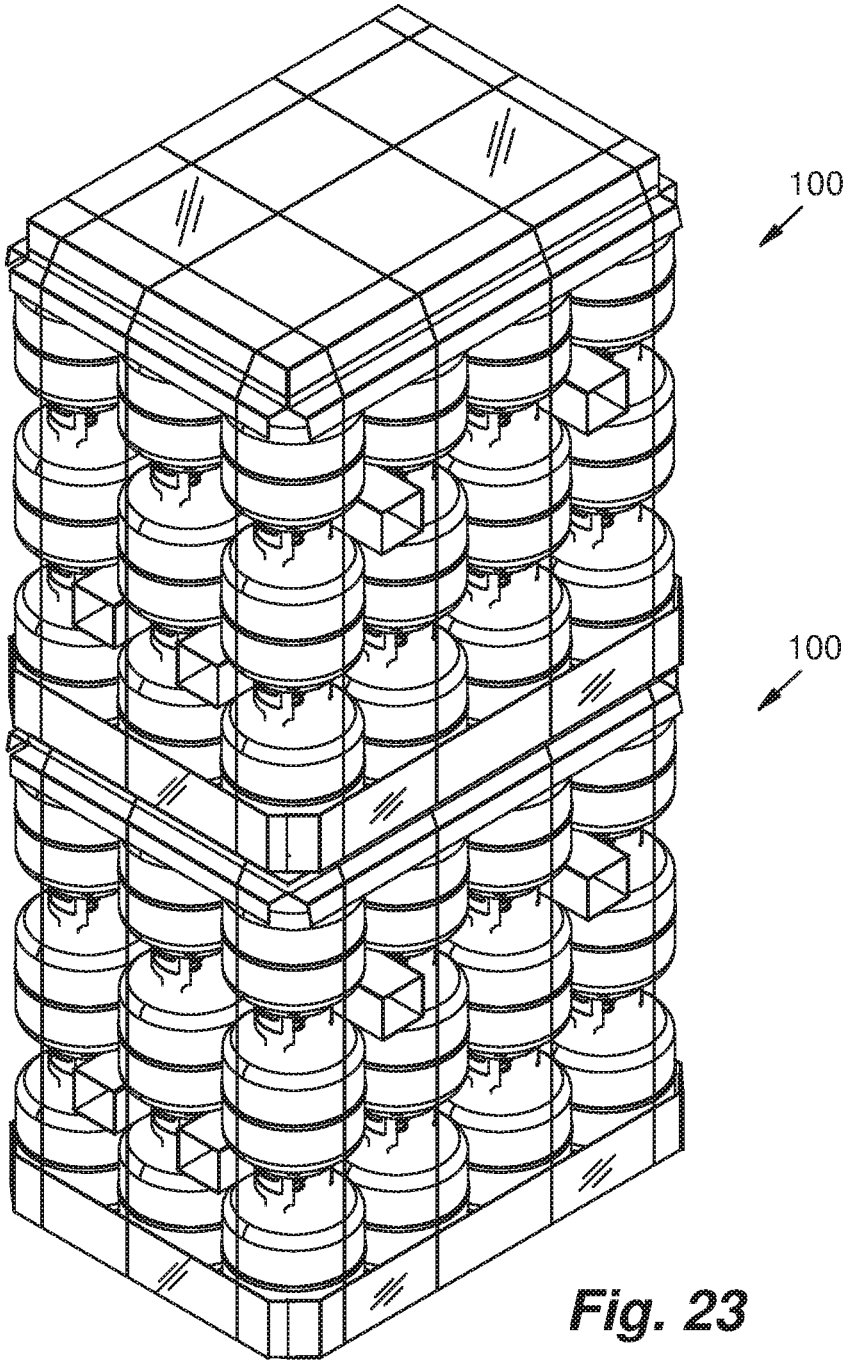
FIG. 23 is a diagrammatic perspective view two systems in accordance with the present invention in vertically stacked configuration.

Embodiments in accordance with the present invention eliminate the need for a pallet to support the load of gas cylinders during forklift operations, while ensuring the lifting load is adequately distributed about the shipping system 100. By way of example, preferred three-level configurations of the present invention, such as the one shown in FIG. 1, allow two systems 100 to be stacked on top of one another while fitting in a typical large shipping truck. See, for example, FIG. 23. There is no need for a pallet to support the arrays of gas cylinders, as is generally relied on in the conventional art. Thus, 72 gas cylinders can be shipped in a truck using roughly the same shipping volume and footprint as the conventional 60-unit (5-level high) cylinder shipment configuration requires.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of packaging an array of gas cylinders for palletless shipment thereof, said method comprising:

providing a base tray element;

placing a first subarray of said gas cylinders on said base tray element, wherein said first subarray has at least three columns extending in a depth direction and at least three rows extending in a width direction, each said gas cylinder including a handle portion and an opposing foot portion;

providing a pair of first tunnel elements, each being configured to releasably receive a corresponding forklift tong;

positioning said first tunnel elements between pairs of said handle portions of said first subarray such that said first tunnel elements extend in said width direction; and placing a second subarray of said gas cylinders on top of said first subarray such that the foot portions of said second subarray are in nesting engagement with said handle portions of said first subarray.

2. A method as defined in claim 1, further comprising:

providing a pair of second tunnel elements each being configured to releasably receive a corresponding forklift tong;

positioning said second tunnel elements between pairs of said handle portions of said second subarray such that said second tunnel elements extend in said depth direction; and placing a third subarray of said gas cylinders on top of said second subarray such that the foot portions of said third subarray are in nesting engagement with said handle portions of said second subarray.

3. A method as defined in claim 2, further comprising:

providing a plurality of pillar elements, each said pillar element including a first tunnel receiving aperture and a second tunnel receiving aperture;

vertically positioning each said pillar element within a respective void defined by four adjacent said gas cylinders in said first subarray;

during said positioning of said first tunnel elements, inserting said first tunnel elements through at least one respective said first tunnel receiving aperture; and during said positioning of said second tunnel elements, inserting each said second tunnel element through at least one respective said second tunnel receiving aperture.

4. A method as defined in claim 3 in which, in each said pillar element, said first tunnel receiving aperture is orthogonal to said second tunnel receiving aperture.

5. A method as defined in claim 3 in which each said pillar element includes flap members extendable radially thereof, and further comprising:

placing each said flap member in protective disposition between weld lines of a respective pair of adjacent said gas cylinders.

6. A method as defined in claim 3, further comprising:

placing a cap element in at least partial receiving engagement with said third subarray; and substantially rigidly securing said subarrays, base tray element and cap element together.

7. A method as defined in claim 6 further comprising:

forming said base tray element from a respective base tray blank;

forming said first tunnel elements from respective first tunnel blanks;

forming said second tunnel elements from respective second tunnel blanks;

forming said pillar elements from respective pillar blanks; and forming a cap element from a respective cap blank.

8. A method as defined in claim 7 in which one or more said blanks are comprised of corrugated cardboard.

* * * * *